US008773327B2

(12) United States Patent
Ryu

(10) Patent No.: US 8,773,327 B2
(45) **Date of Patent: *Jul. 8, 2014**

(54) DISPLAY APPARATUS AND CONTROL METHOD THEREOF

(71) Applicant: Samsung Electronics Co., Ltd., Gyeonggi-do (KR)

(72) Inventor: Kwang-choon Ryu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/669,598

(22) Filed: Nov. 6, 2012

(65) Prior Publication Data

US 2013/0063503 A1 Mar. 14, 2013

Related U.S. Application Data

(63) Continuation of application No. 12/202,671, filed on Sep. 2, 2008, now Pat. No. 8,330,671.

(30) Foreign Application Priority Data

Oct. 11, 2007 (KR) ..... 10-2007-0102765

(51) Int. Cl.
*G09G 5/00* (2006.01)

(52) U.S. Cl.
USPC ..... 345/1.3; 345/204

(58) Field of Classification Search
USPC ..... 345/1.1–3, 4, 204, 87, 60, 76, 82
See application file for complete search history.

(56) References Cited

U.S. PATENT DOCUMENTS

| | | | |
|---|---|---|---|
| 6,836,787 | B1 | 12/2004 | Kasai et al. |
| 7,292,284 | B2 | 11/2007 | Kim |
| 7,364,313 | B2 | 4/2008 | De Meerleer |
| 7,864,249 | B2 | 1/2011 | Kim |
| 2004/0046772 | A1 | 3/2004 | Ouchi et al. |
| 2004/0263686 | A1 | 12/2004 | Kim |
| 2007/0097609 | A1 | 5/2007 | Moscovitch |
| 2007/0120763 | A1 | 5/2007 | De Paepe et al. |
| 2008/0012989 | A1 | 1/2008 | Kim |
| 2008/0055189 | A1 | 3/2008 | Wilk et al. |

FOREIGN PATENT DOCUMENTS

| | | | |
|---|---|---|---|
| EP | 1 164 461 | A1 | 12/2001 |
| JP | 2000-214836 | A | 8/2000 |
| KR | 10-0580245 | B1 | 5/2006 |

OTHER PUBLICATIONS

Search Report dated May 2, 2010 from the European Patent Office in European Patent Application No. 08164066.6.

Communication dated Nov. 26, 2013, issued by the Korean Intellectual Property Office in counterpart Korean Application No. 10-2007-0102765.

*Primary Examiner* — Stephen Sherman
(74) *Attorney, Agent, or Firm* — Sughrue Mion, PLLC

(57) ABSTRACT

A display apparatus and a control method thereof are provided. The display apparatus displays first image data, received from a computer through a first interface, and second image data, received from the computer through a second interface, together. Accordingly, a single monitor can display image data from two or more interfaces together when the monitor receives image data from a single computer through the two or more interfaces.

7 Claims, 6 Drawing Sheets

DISPLAY APPARATUS AND CONTROL METHOD THEREOF

CROSS-REFERENCE TO RELATED APPLICATIONS

This is a continuation of U.S. application Ser. No. 12/202,671 filed Sep. 2, 2008 (now allowed), which application claims priority from Korean Patent Application No. 10-2007-0102765, filed on Oct. 11, 2007 in the Korean Intellectual Property Office, the disclosures of each of which are incorporated herein by reference in their entirety.

BACKGROUND OF THE INVENTION

1. Field of the Invention

Apparatuses and methods consistent with the present invention relate to a display apparatus and a control method thereof, and more particularly, to an apparatus which displays image signals input from a computer through a plurality of interfaces, and a control method thereof.

2. Description of the Related Art

As computers have become widely used, two or more monitors are now commonly used to display different images. When a user performs jobs using two or more windows on only a single monitor, the user must close one window to view another window, resulting in inconvenience. Accordingly, it is now possible for a user to perform jobs by connecting two monitors to a single computer and displaying different windows on each monitor. As a result, inconvenience resulting from the need to close one window to view another window has been removed, but the burden of purchasing two monitors is another problem.

Recently, many widescreen monitors have been released. Monitors generally have an aspect ratio (horizontal length to vertical length) of 4:3, and widescreen monitors generally have an aspect ratio of 16:9. The horizontal length with respect to the vertical length of widescreen monitors is longer than that of general monitors. Accordingly, if a window having the same size as a window displayed on a general monitor is displayed on a widescreen monitor, extra space on the monitor which is not occupied by the window can be utilized.

Accordingly, it is easier for the user to perform jobs by opening two or more windows simultaneously. However, there is a problem of adjusting the size and location of the windows in order for each window not to overlap with other windows.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present invention provides a display apparatus which is able to display each image data together when a single monitor receives image data from a single computer through two or more interfaces.

The present invention also provides a display apparatus which is able to display each image data together when a single monitor receives image data from two or more computers through their interfaces.

The present invention also provides a display apparatus which is able to individually perform scaling of image data and display the image data together when a single monitor receives image data from an external device through two or more interfaces.

The present invention also provides a control method for displaying each image data together when image data are received from at least one computer through two or more interfaces.

According to one exemplary aspect of the present invention, there is provided a display apparatus which receives image data from a computer, the display apparatus including a display unit, a first interface through which first image data are received from the computer, a second interface through which second image data are received from the computer, a signal processing unit which processes the first image data and the second image data to be displayed, and a control unit which controls the display unit to display the first image data and the second image data together.

The display apparatus may further include a combining unit which selectively transmits at least one of the processed first image data and the processed second image data to the display unit.

If the first image data and the second image data are received together, the control unit may control the display unit to display the first image data and the second image data together, and if only one of the first image data and the second image data are received, the control unit controls the display unit to display the received image data.

The display apparatus may further include a first storage unit which stores information regarding a resolution for an area for displaying the first image data, wherein the information stored in the storage unit is transmitted to the computer using display data channel (DDC) communication.

The display apparatus may further include a second storage unit which stores information regarding a resolution for an area for displaying the second image data, wherein the information stored in the storage unit is transmitted to the computer using DDC communication.

The display apparatus may further include a user input unit which receives a user command to display the first image data and the second image data together, wherein the control unit operates the display unit to display the first image data and the second image data together if the user commend is received.

The display apparatus may further include an on-screen display (OSD) generation unit which generates a menu to guide the user to input the command to display the first image data and the second image data together, wherein the control unit controls the OSD generation unit to display the generated menu.

The signal processing unit comprises a first scaler which converts the first image data to a resolution corresponding to a resolution of an area for displaying the first image data, and a second scaler which converts the second image data to a resolution corresponding to a resolution of an area for displaying the second image data.

The first interface may receive digital image data and the second interface may receive analog image data.

The signal processing unit may include a first signal processing unit which processes the first image data, and a second signal processing unit which processes the second image data.

According to an exemplary aspect of the present invention, there is provided a display apparatus which receives image data from two or more computers, the display apparatus including a display unit, a first interface through which first image data are received from a first computer, a second interface through which second image data are received from a second computer, a signal processing unit which processes the first image data and the second data to be displayed, and a control unit which controls the display unit to display the first image data and the second image data together.

The signal processing unit may include a first signal processing unit which processes the first image data, and a second signal processing unit which processes the second image data.

According to an exemplary aspect of the present invention, there is provided a display apparatus which receives image data from an external device, the display apparatus including a display unit, a first interface through which first image data are received from the external device, a second interface through which second image data are received from the external device, a first scaler which converts the first image data to a format and resolution corresponding to an area for displaying the first image data, a second scaler which converts the second image data to a format and resolution corresponding to an area for displaying the second image data, and a control unit which controls the display unit to display the first image data and the second image data together.

According to an exemplary aspect of the present invention, there is provided a method for controlling a display, the method including determining whether image data are received through at least one of a first interface and a second interface from at least one computer, and displaying first image data and second image data together if the first image data are received through the first interface and the second image data are received through the second interface.

In the displaying operation, if image data are received through only one of the first interface and the second interface, the received image data are displayed.

The method may further include generating a menu in order for a user to input a user command to display first image data received through the first interface and second image data received through the second interface together.

The method may further include transmitting the user command to the computer if the user command is input through the menu.

The method may further include converting the first image data received through the first interface to a resolution corresponding to a resolution of an area for displaying the first image data.

The method may further include converting the second image data received through the second interface to a resolution corresponding to a resolution of an area for displaying the second image data.

The first image data may be converted to a resolution corresponding to a resolution of an area for displaying the first image data.

The second image data may be converted to a resolution corresponding to a resolution of an area for displaying the second image data.

In the displaying operation, the image data received through the first interface and the image data received through the second interface may be combined and displayed.

The method may further include receiving a user command to display the first image data and the second image data together if the first image data are received through the first interface and the second image data are received through the second interface, wherein in the displaying operation, the first image data and the second image data are displayed together if the user command is received.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
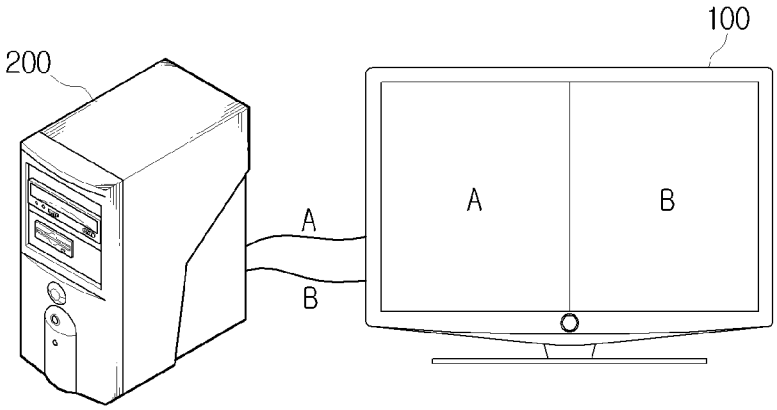
FIG. 1 is a schematic perspective view of a display system according to an exemplary embodiment of the present invention.

Certain exemplary embodiments of the present invention will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1 is a schematic perspective view of a display system according to an exemplary embodiment of the present invention. The display apparatus 100 can perform DDC communication with a single computer 200 through two interfaces. A single computer may also communicate with a single display apparatus through three or more interfaces.

If image data are input to the display apparatus 100 through an interface A and an interface B, image data input through the interface A may be displayed on an area A of the display apparatus 100 and image data input through the interface B may be displayed on an area B of the display apparatus 100.

If image data are input through either the interface A or the interface B, the image data may be displayed on area A+B.

That is, image data input only through interface A or image data input only through interface B may be displayed on the entire screen (area A+B).

Figure 2:
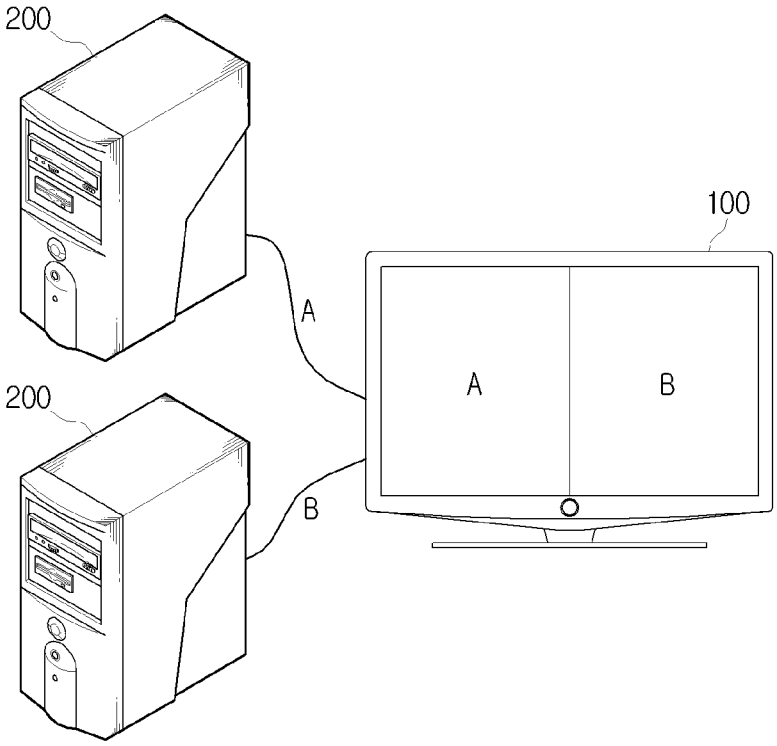
FIG. 2 is a schematic perspective view of a display system according to another exemplary embodiment of the present invention.

FIG. 2 is a schematic perspective view of a display system according to another exemplary embodiment of the present invention. The display apparatus 100 can perform DDC communication with two computers 200 through their own interfaces. Three or more computer may also communicate with a single display apparatus through their own interfaces.

If image data are input to the display apparatus 100 through an interface A and an interface B, image data input through the interface A may be displayed on an area A of the display apparatus 100 and image data input through the interface B may be displayed on an area B of the display apparatus 100.

If image data are input through the interface A or the interface B, the image data may be displayed on area A+B.

That is, image data input only through interface A or image data input only through interface B may be displayed on the entire screen (area A+B).

Figure 3:
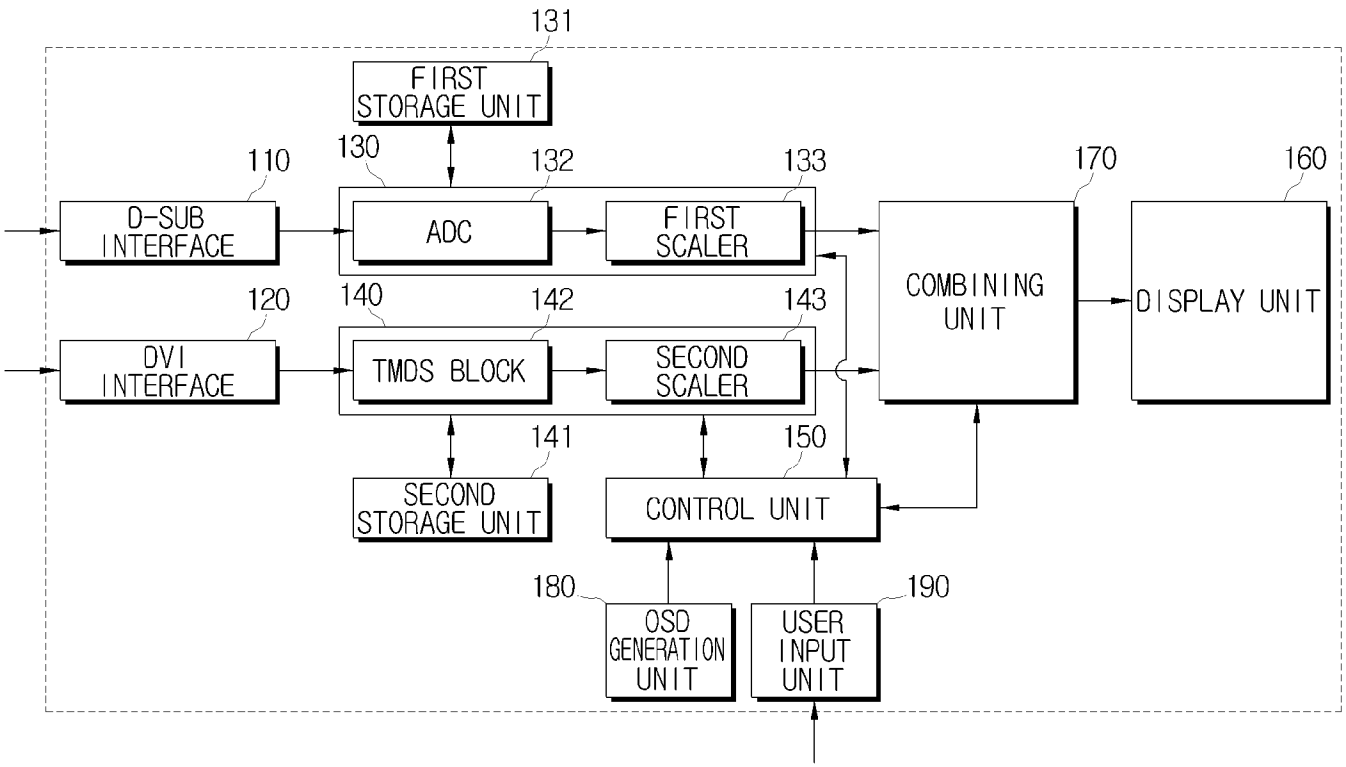
FIG. 3 is a block diagram of a display apparatus according to an exemplary embodiment of the present invention.

FIG. 3 is a block diagram of the display apparatus 100 according to an exemplary embodiment of the present invention.

The display apparatus 100 includes a D-SUB interface 110, a digital video interactive (DVI) interface 120, a first signal processing unit 130, a first storage unit 131, a second signal processing unit 140, a second storage unit 141, a control unit 150, a display unit 160, a combining unit 170, an OSD generation unit 180, and a user input unit 190.

The D-SUB interface 110 is connected to a computer 200 (shown in FIGS. 1 and 2) through a D-SUB port and receives analog image data from the computer 200.

The DVI interface 120 is connected to the computer 200 through a DVI port and receives digital image data from the computer 200.

The first signal processing unit 130 converts first image data transmitted to the display apparatus 100 through the D-SUB interface 110 into image data of a displayable format and resolution, and transmits the converted image data to the combining unit 170. The first signal processing unit 130 includes an analog to digital converter (ADC) 132 and a scaler 133.

The ADC 132 converts analog data into digital data, and the scaler 133 performs scaling of the first image data input through the D-SUB interface 110 so as to be adjusted to the resolution of an area for displaying the first image data, and transmits the scaled first image data to the combining unit 170.

The second signal processing unit 140 converts second image data transmitted to the display apparatus 100 through the DVI interface 120 into image data of a displayable format and resolution, and transmits the converted image data to the combining unit 170. The second signal processing unit 140 includes a Transition Minimized Differential Signaling (TMDS) block 142 and a scaler 143.

The TMDS block 142 converts digital data into a TMDS signal, and the scaler 143 performs scaling of the second image data input through the DVI interface 120 so as to be adjusted to the resolution of an area for displaying the second image data, and transmits the scaled second image data to the combining unit 170.

The first storage unit 131 stores Extended Display Identification Data (EDID) information of the display apparatus 100. The EDID information includes information regarding the resolution of an area for displaying the first image data. The resolution information may include resolution information regarding a display area when the first image data are displayed together with the second image data, and resolution information regarding a display area when only the first image data are displayed.

The second storage unit 141 stores EDID information of the display apparatus 100. The EDID information includes information regarding the resolution of an area for displaying the second image data. The resolution information may include resolution information regarding a display area when the second image data are displayed together with the first image data, and resolution information regarding a display area when only the second image data are displayed.

If the combining unit 170 receives image data through only one of the first interface 110 and the second interface 120, the combining unit 170 transmits the received image data to the display unit 160, and if the combining unit 170 receives image data through both the first interface 110 and the second interface 120, the combining unit 170 outputs the first image data and the second image data together to the display unit 160, or combines the first image data and the second image data and outputs them to the display unit 160.

The display unit 160 displays image data received to the display apparatus 100, and may be a liquid crystal display (LCD), a plasma display panel (PDP), or a cathode ray tube (CRT).

The OSD generation unit 180 generates as an OSD a menu which receives a user command to display the first image data and the second image data together.

The user input unit 190 receives the user command to display the first image data and the second image data together from the user. The user command may be input using the menu output by the OSD generation unit 180. The user input unit 190 may be buttons mounted on the display apparatus 100. The user command may also be input using a mouse (not shown) or a key board (not shown) connected to the display apparatus 100 or the computer 200.

The control unit 150 determines whether the first image data or the second image data are received. If both the first image data and the second image data are received, the control unit 150 operates the combining unit 170 so as to display the first image data and the second image data together. If either the first image data or the second image data are received, the control unit 150 operates the combining unit 170 so as to display only the received image data.

The control unit 150 operates the OSD generation unit 180 to output the menu which receives the user command to display the first image data and the second image data together, and operates the combining unit 170 to display the first image data and the second image data together if the user command to display the first image data and the second image data together is received.

One or more of the first signal processing unit 130, the second signal processing unit 140, the first storage unit 131, the second storage unit 141, the control unit 150, the combining unit 170, and the OSD generation unit 180 may be integrated together in one chip.

Figure 4:
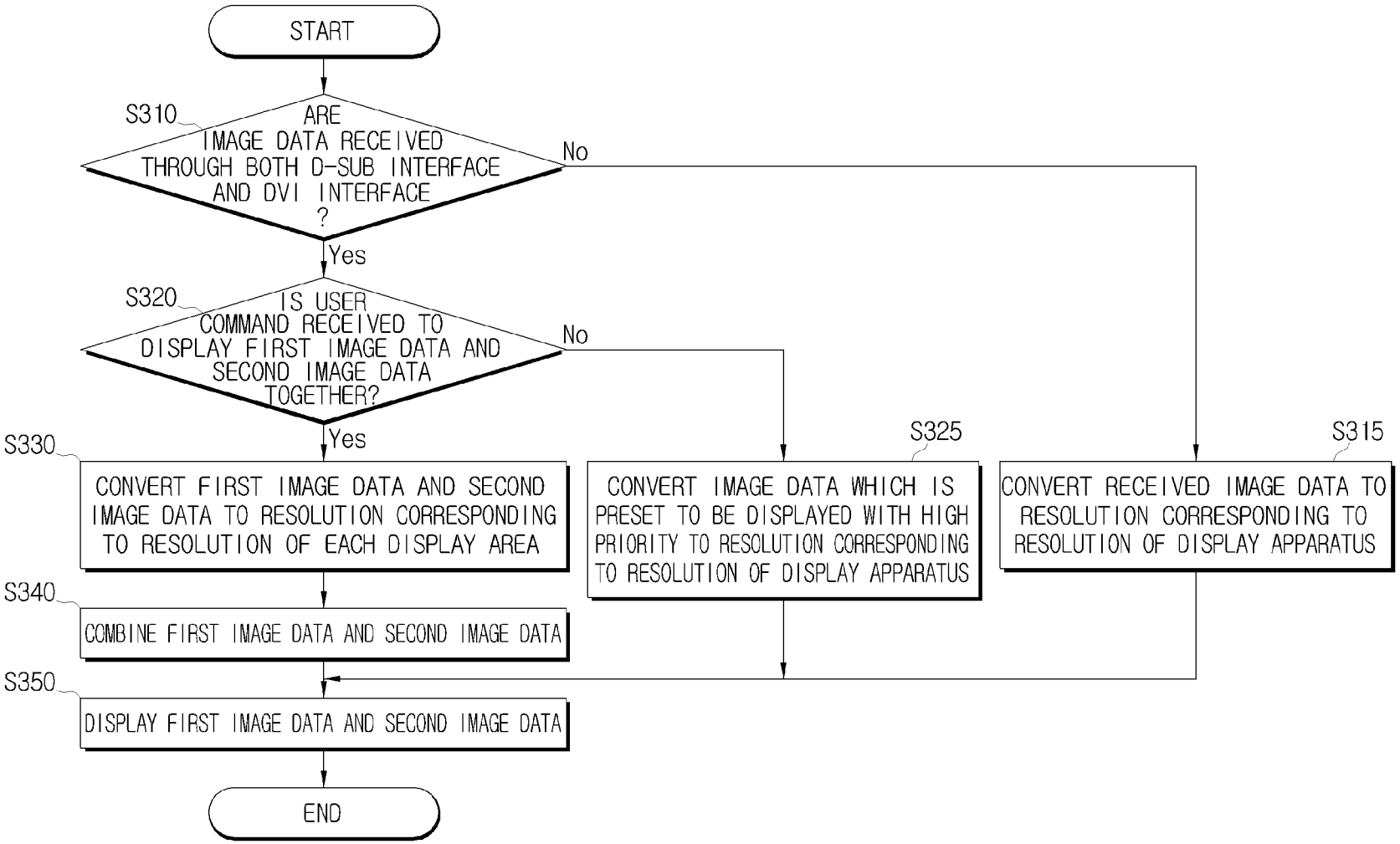
FIG. 4 is a flow chart illustrating a method of displaying two or more images together according to an exemplary embodiment of the present invention.

FIG. 4 is a flow chart illustrating a method for displaying two or more images together according to an exemplary embodiment of the present invention.

The single display apparatus 100 is connected to the single computer 200 through the D-SUB interface 110 and the DVI interface 120, and the display apparatus 100 includes the two signal processing units 130 and 140 to process first and second image data input through the two interfaces 110 and 120. The two signal processing units 130 and 140 may be integrated in one chip.

Firstly, in operation 5310, the display apparatus 100 determines whether image data are received through both the D-SUB interface 110 and the DVI interface 120. If image data are not received through both the D-SUB interface 110 and the DVI interface 120 in operation S310-N, the received image data are adjusted to have a resolution for the display apparatus 100 in operation 5315, and are displayed in operation 5350. The resolution for the display apparatus 100 may be a resolution corresponding to the entire screen (area A+B) of the display unit 160 of the display apparatus 100, or a resolution corresponding to a part of screen (area A or B) of the display unit 160.

If image data are received through both the D-SUB interface 110 and the DVI interface 120 in operation S310-Y, it is determined whether a user command to display the first image data and the second image data together is received in operation S320. If the user command is not received in operation S320-N, image data which is preset to be displayed on the display apparatus 100 with high priority from among the received image data are adjusted to have the resolution for the display apparatus 100 in operation S325, and are displayed in operation S350. The image data which is preset to be displayed on the display apparatus 100 with high priority may be digital image data or analog image data. The resolution for the display apparatus 100 may be a resolution corresponding to the entire screen (area A+B) of the display unit 160 of the display apparatus 100, or a resolution corresponding to a part of screen (area A or B) of the display unit 160.

If the user command is received in operation S320-Y, the first image data and the second image data are adjusted, respectively, to have the resolution for each display area (area A and B) in operation S330, are combined in operation S340, and are displayed in operation S350. The resolution for each display area (area A or B) may be set personally by the user.

The above process can also be applied when two or more computers 200 are connected to a single display apparatus 100 through two interfaces or through three or more interfaces.

Figure 5:
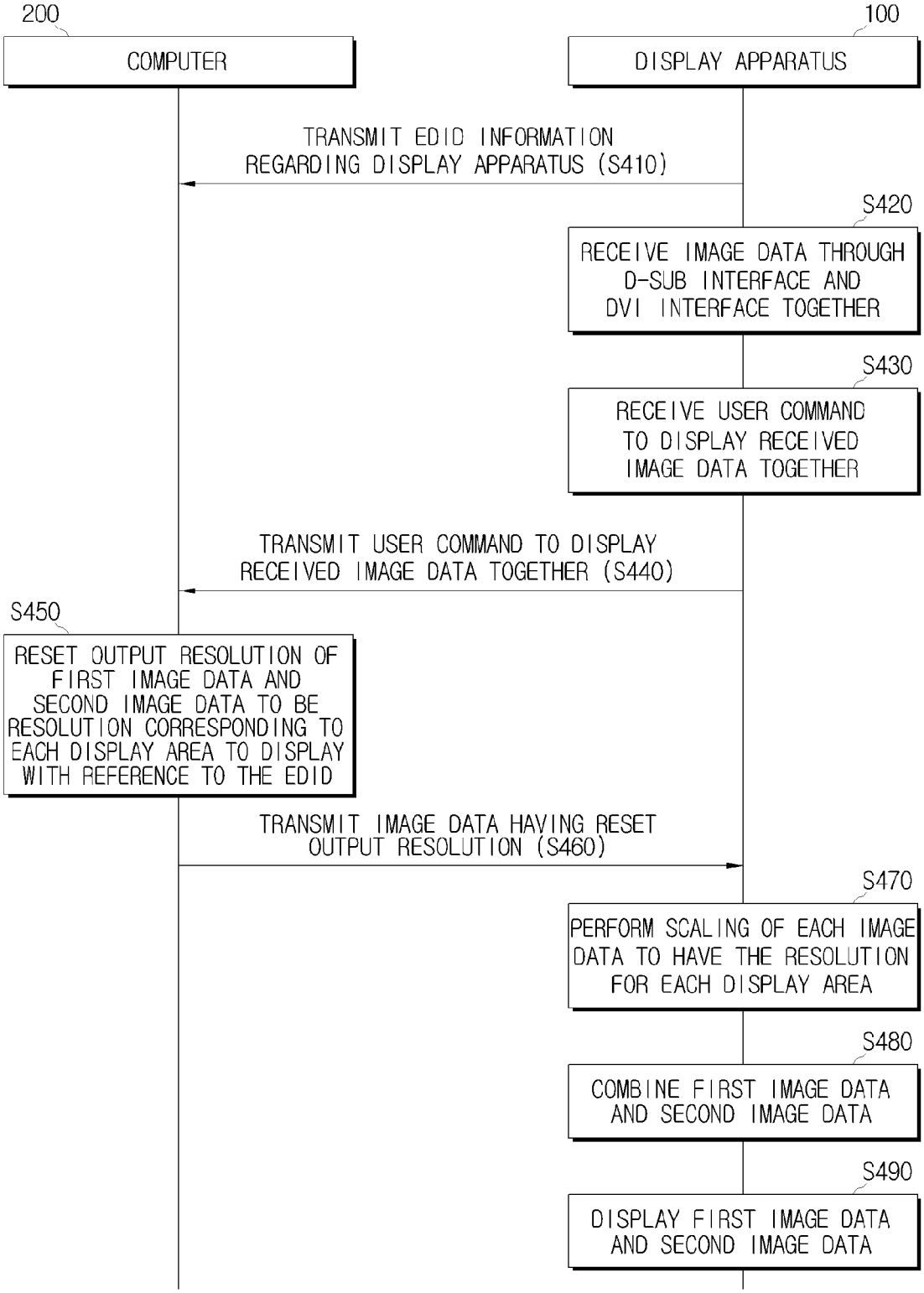
FIG. 5 is a flow chart illustrating a method of displaying two or more images by a computer adjusting the resolution of the two or more images according to another exemplary embodiment of the present invention.

FIG. 5 is a flow chart illustrating a method for displaying two or more images by a computer which adjusts the resolution of the two or more images according to another exemplary embodiment of the present invention.

The single display apparatus 100 is connected to the single computer 200 through the D-SUB interface 110 and the DVI interface 120, and the display apparatus 100 includes the two signal processing units 130 and 140 to display first and second image data input through the two interfaces 110 and 120. The two signal processing units 130 and 140 may be integrated in one chip.

In operation S410, the display apparatus 100 transmits EDID information regarding the display apparatus 100 to the computer 200. The EDID information may include information regarding a resolution of an area for displaying the image data.

The resolution information may include resolution information regarding a display area when the first image data are displayed together with the second image data, and resolution information regarding a display area when only one of the first image data and the second image data are displayed.

Alternatively, the resolution information may include resolution information regarding a display area when the second image data are displayed together with the first image data, and resolution information regarding a display area when only one of the first image data and the second image data are displayed.

Subsequently, the display apparatus 100 determines that the first image data and the second image data are received together through the D-SUB interface 110 and the DVI interface 120 in operation S420, and that a user command to display the received image data together is received in operation S430.

If the display apparatus 100 transmits a command to display the received image data together to the computer 200 in operation S440, the computer 200 resets output resolution of the first image data and the second image data to a resolution corresponding to the resolution of display area for displaying with reference to the EDID information in operation S450.

If the resolution of the display apparatus 100 is 1024×768 and the size of each display area for displaying each image data is the same, the resolution of the display apparatus 100 included in the EDID information may include 512×768. Accordingly, the computer 200 can reset the output resolution to a resolution which is most suitable for the resolution of the display apparatus 100 of 512×768.

If the computer 200 transmits the image data having the reset output resolution to the display apparatus 100 in operation S460, the display apparatus 100 performs scaling of each image data so as to be adjusted to the resolution for each display area in operation S470, combines the image data in operation S480, and displays in operation S490.

The above process can also be applied when two or more computers 200 are connected to a single display apparatus 100 through two interfaces or through three or more interfaces.

Figure 6:
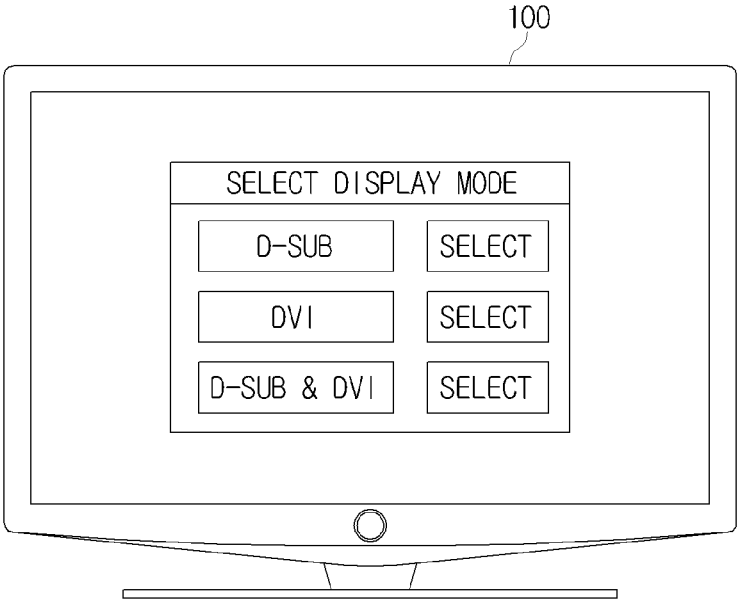
FIG. 6 is an example of a screen depicting a menu according to an exemplary embodiment of the present invention.

FIG. 6 is an example of a screen depicting a menu according to an exemplary embodiment of the present invention. The menu may also be displayed in different forms.

As described above, each interface according to an exemplary embodiment of the present invention is implemented as a D-SUB interface 110 or a DVI interface 120. Each interface may also be implemented as one of D-SUB, DVI, USB, HDMI, and Display Port interfaces.

As described above, each interface has different type. However, multiple interfaces may be of the same type. In addition, the first storage unit 131 and the second storage unit 141 may be integrated as a single storage unit. Also, the scaler 133 and the scaler 143 may be integrated as a single scaler.

As described above, the display apparatus 100 is connected to the computer 200. However, the display apparatus 100 may be connected to external devices other than the computer 200.

As described above, the size of area A to display the first image data input through the first interface is the same as the size of area B to display the second image data input through the second interface. However, the size of area A may be different from the size of area B.

Figure 7:
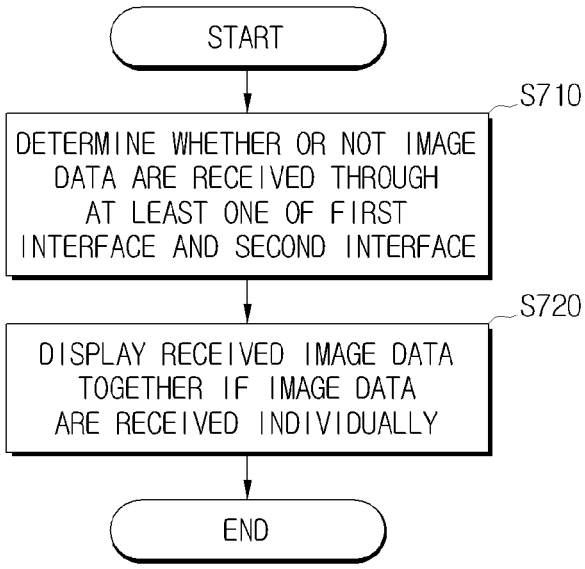
FIG. 7 is a flow chart illustrating a display control method according to another exemplary embodiment of the present invention.

FIG. 7 is a flow chart illustrating a display control method according to another exemplary embodiment of the present invention. Firstly, in operation S710, the display apparatus determines whether image data are received through at least one of the first interface and the second interface. In operation S720, if image data are received through both the first interface and the second interface, an image apparatus displays the received image data together. Accordingly, two or more images received by the single display apparatus can be displayed together.

As can be appreciated from the above description, a single monitor can display image data together when the monitor receives image data from a single computer through two or more interfaces.

In addition, a single monitor can display image data together when a single monitor receives image data from two or more computers through two or more interfaces.

In addition, a single monitor can display image data together by individually scaling each image data when a single monitor receives image data from an external device through two or more interfaces.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A display apparatus which receives image data from at least one external device, the display apparatus comprising:

a single display unit;

a single interface through which first image data are received from a first external device and through which second image data are received from a second external device;

a signal processing unit which processes the first image data to be displayed on a first area of the single display unit and processes the second image data to be displayed on a second area of the single display unit;

a control unit which controls the display unit to display the first image data and the second image data together, and a combining unit which selectively transmits one of the processed first image data and the processed second image data to the display unit, when only one of the first image data and the second image data is received by the combining unit, wherein the signal processing unit processes the first image data in a resolution corresponding to the first area of the single display unit and processes the second image data in a resolution corresponding to the second area of the single display unit and processes the received image data in a full resolution of the single display unit when only one of the first image data and the second image data are received.

2. The display apparatus of claim 1, wherein if the first image data and the second image data are received together, the control unit controls the display unit to display the first image data and the second image data together, and if only one of the first image data and the second image data are received, the control unit controls the display unit to display the received image data.

3. The display apparatus of claim 1, further comprising a first storage unit which stores information regarding a resolution for an area for displaying the first image data, wherein the information stored in the storage unit is transmitted to the computer using display data channel (DDC) communication.

4. The display apparatus of claim 3, further comprising a second storage unit which stores information regarding a resolution for an area for displaying the second image data wherein the information stored in the storage unit is transmitted to the computer using DDC communication.

5. The display apparatus of claim 1, further comprising a user input unit which receives a user command to display the first image data and the second image data together, wherein the control unit controls the display unit to display the first image data and the second image data together if the user command is received.

6. The display apparatus of claim 5, further comprising an on-screen display (OSD) generation unit which generates a menu through which the user command to display the first image data and the second image data together is received, wherein the control unit controls the OSD generation unit to display the generated menu.

7. The display apparatus of claim 1, wherein the interface comprises;

a first interface through which the first image data are received; and a second interface through which the second image data are received.

* * * * *